US005088073A

United States Patent [19]

Speas

[11] Patent Number: 5,088,073

[45] Date of Patent: Feb. 11, 1992

[54] STATUS INDICATOR FOR AN ELECTRONIC PARKING METER

[75] Inventor: Gary W. Speas, Little Rock, Ark.

[73] Assignee: Pom, Inc., Russellville, Ark.

[21] Appl. No.: 615,163

[22] Filed: Nov. 19, 1990

[51] Int. Cl.[5] ..... G04F 1/00

[52] U.S. Cl. ..... 368/90

[58] Field of Search ..... 368/90; 235/384; 194/901

[56] References Cited

U.S. PATENT DOCUMENTS

| | | | |
|---|---|---|---|
| 3,518,664 | 6/1970 | Taylor | 340/373 |
| 3,750,138 | 7/1973 | Burgan et al. | 340/334 |
| 4,183,205 | 1/1980 | Kaiser | 368/90 |
| 4,310,890 | 1/1982 | Trehn et al. | 368/90 |
| 4,827,206 | 5/1989 | Speas | 323/229 |
| 4,861,971 | 8/1989 | Chan | 368/90 |

OTHER PUBLICATIONS

Ferranti Packard, "Status Indicators" Indicators with a Memory, 4 pages (Product Information Brochure).

Signalex, 6 pages (product Information Brochure).

*Primary Examiner*—Vit W. Miska

*Attorney, Agent, or Firm*—Hill, Van Santen, Steadman & Simpson

[57] ABSTRACT

An electronic parking meter, having a flip-dot display arranged within a viewing area of an electronic parking meter housing, and selectively connected to a magnetic pulse generating circuit by a magnetic field, where the magnetic pulse generating circuit is driven by a microprocessor in the electronic parking meter, produces a highly visible light-reflecting display, such that an operating message in the viewing area is readily discernable to a viewer or law enforcement official.

3 Claims, 2 Drawing Sheets

FIG. 1
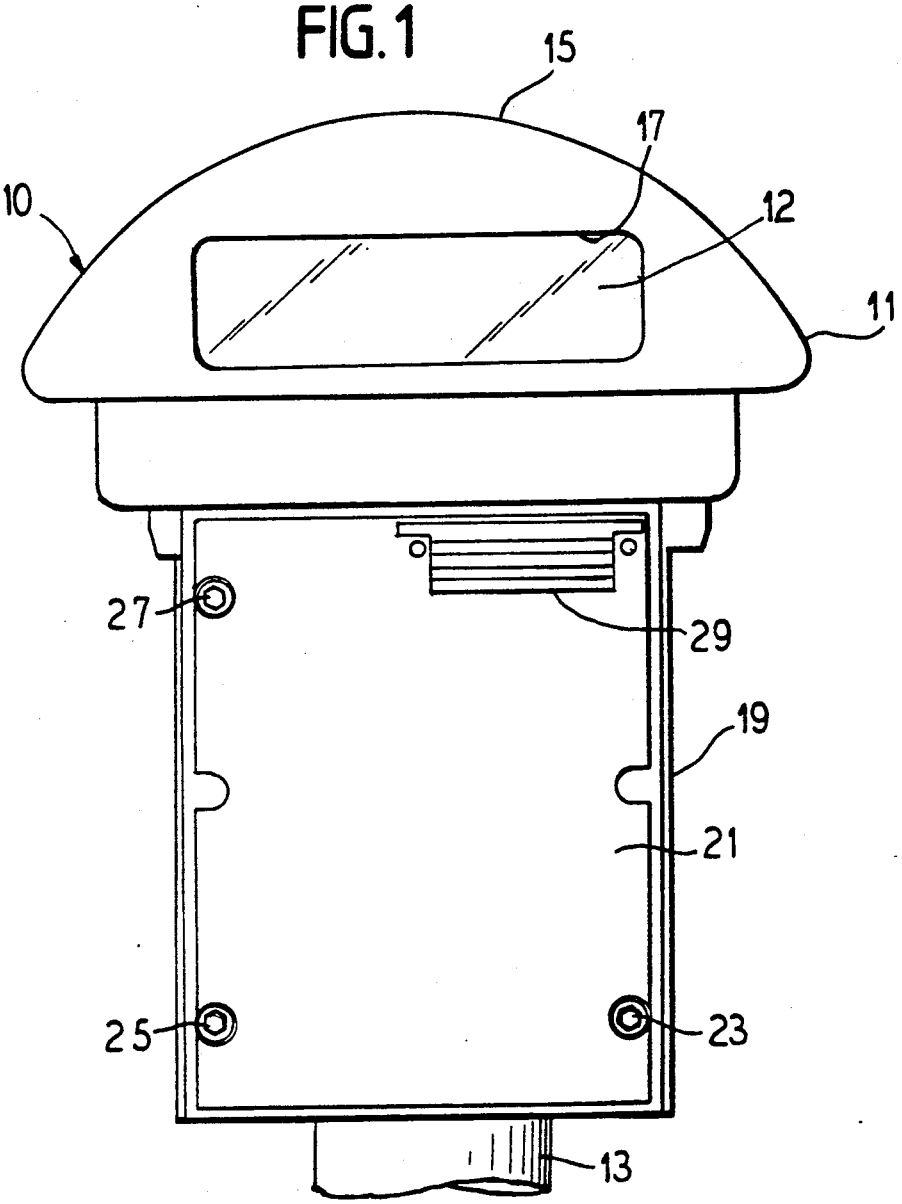
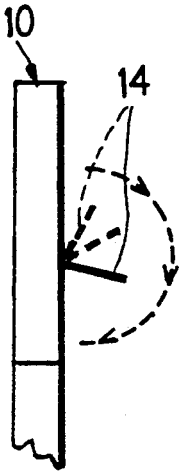
FIG. 2

STATUS INDICATOR FOR AN ELECTRONIC PARKING METER

BACKGROUND OF THE INVENTION

1. Field of the Invention

The present invention relates to an electronic parking meter.

2. History of the Prior Art

An electronic parking meter, capable of responding to activation of an operating mechanism in response to a parking meter insert by displaying an associated time interval appropriate to the value of a time increment, is disclosed in U.S. Pat. No. 4,827,206. The parking meter insert can be a coin, card, token, or any other associated time measuring device. The parking meter displays the associated time interval to a viewer by an LCD display. As the visibility of the LCD display is limited, the associated time interval is not readily discernable by viewers having vehicles parked in a parking space associated with the electronic parking meter, or by law enforcement personnel monitoring the electronic parking meter.

U.S. Pat. No. 3,518,664 discloses a highly visible display means which comprises a magnetically actuatable element having a visual surface and a magnetic bias. The magnetically actuatable element is rotated by the application of a selectively reversible magnetic field. The magnetic field is suitably disposed to supply rotational torque to the rotatable element to produce a desired display.

SUMMARY OF THE INVENTION

The present invention relates to an electronic parking meter having a highly visible viewer display.

To this end, a microprocessor of an electronic parking meter is electrically connected to a magnetic pulse generating circuit for delivering a magnetic pulse to a flip-dot display, or status indicator, located in the viewing area of an electronic parking meter housing.

An electronic circuit capable of driving the flip-dot display is electrically connected to the microprocessor of the electronic parking meter. The circuit generates a magnetic pulse by means of an inductor. The magnetic pulse selectively rotates the poles of a permanently magnetized disk in the status indicator, as determined by the microprocessor, and holds the disk in position until reactivated by an additional magnetic pulse.

BRIEF DESCRIPTION OF THE DRAWINGS

FIG. 1 is a front elevational view of the housing for the electronic parking meter display system.

FIG. 2 is a side sectional view of the housing for the electronic parking meter display system, showing the sweep of the flip-dot display within the display.

DETAILED DESCRIPTION OF THE PREFERRED EMBODIMENTS

Figure 3:
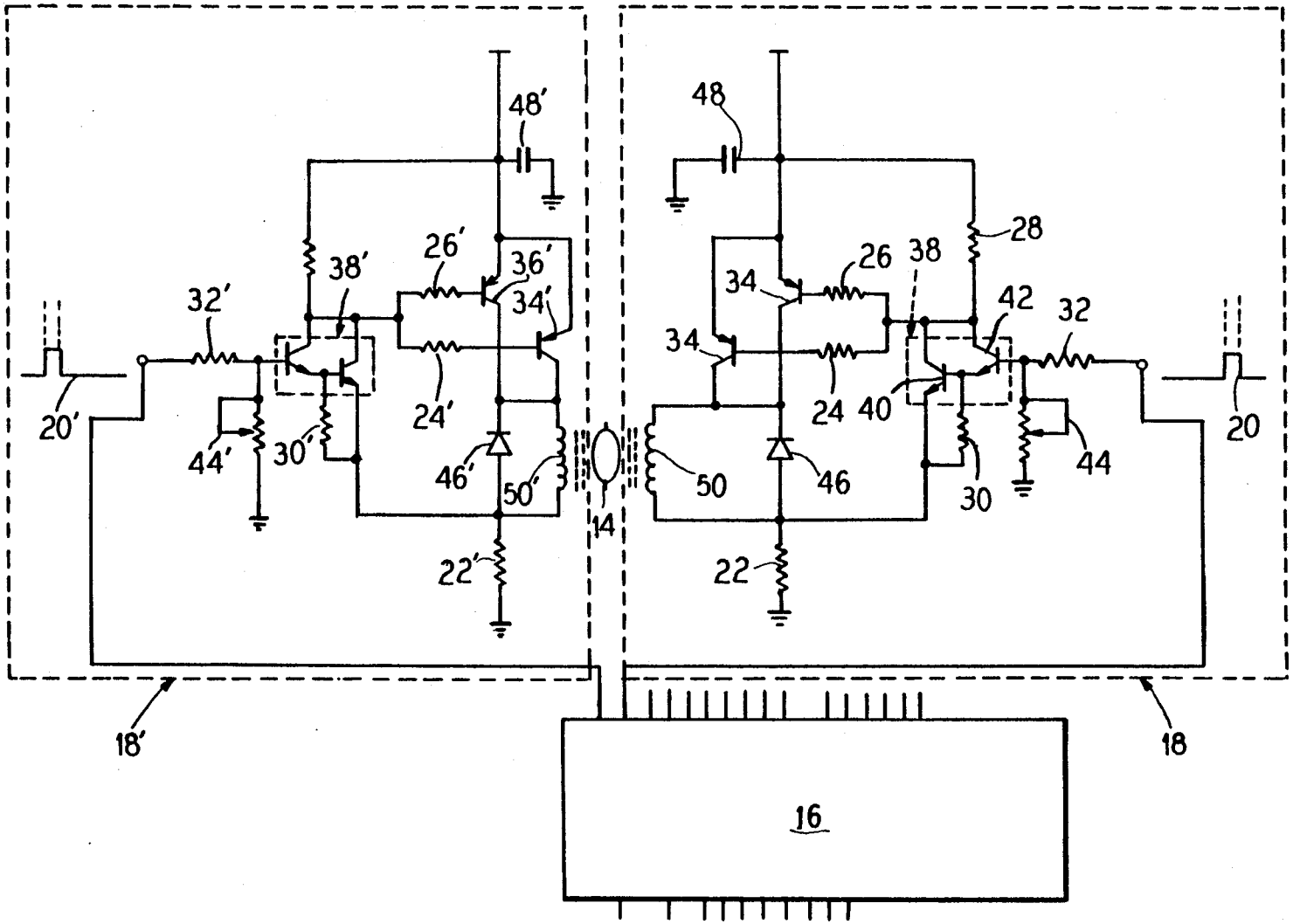
FIG. 3 is a circuit schematic for driving a flip-dot display in an electronic parking meter.

Referring to FIG. 1, a parking meter is shown generally at 10, which includes a housing 11 adapted to be mounted on a pole 13 or a support providing means disposed adjacent to a parking space to be monitored.

The upper portion of the housing 11 is of a dome-shaped configuration as at 15 and includes a transparent wall 17 forming a window, or viewing area 12 through which a display means may be viewed.

In accordance with the latest developments in the parking meter art, it is contemplated that the meter 10 could be a so-called electronic parking meter wherein the usual coin operated mechanical timer means is replaced by a microprocessor.

It is further contemplated that the principles of the present invention could be successfully practiced regardless of how the meter is activated. Thus, any form of insert could be employed to purchase or register an approved increment of time.

There is provided below the dome-shaped portion 15 of the housing 11 a box-like container 19 having a cover 21 connected to the container by a plurality of screw fasteners 23, 25, 27. Near the top of the container 19 but below the line of the dome-shaped portion 15 is provided an insert means 29 into which the insert can be placed, whether it be a magnetic card, a coin, a token, or any form of insert.

In the form of an electronic parking meter heretofore provided, the display appearing in the window 12 is an illuminated display. Previously, the display has been illuminated via the application of an electric field to a liquid crystal display. However, a liquid crystal display does not produce a highly visible display that is readily discernible by an observer. Thus, the integration of a flip-dot display having a magnetic disk 14 as illustrated in FIG. 2, into the circuitry of the electronic parking meter, produces a highly visible display when constructed in accordance with the principles of the present invention, as illustrated in FIG. 3. The magnetic disk 14 is capable of 180° rotation within the window 12 of the parking meter 10, as shown in FIG. 2, when activated by a magnetic pulse within the construction illustrated in FIG. 3.

As illustrated in FIG. 3, a microprocessor 16 is electrically connected to an identical pair of magnetic pulse generating circuits 18, 18'. The microprocessor 16 can be programmed to produce a 3 V, 1 ms input pulse 20 to the circuit 18, or a 3 V, 1 ms input pulse 20' to the magnetic pulse generating circuit 18'. Resistors 32, 32' are serially connected between the input pulses 20, 20' from a microprocessor 16 and a first terminal of center-tapped potentiometers 44, 44'. Darlington pairs 38, 38' consisting of NPN transistors 40, 40', 42, 42' are electrically connected to first terminals of the center-tapped potentiometers 44, 44'. The bases of the transistors 42, 42' are serially connected to the emitters of the transistors 42, 42' via resistors 30, 30'. The collectors of the transistors 40, 40', are connected to VCC via resistors 28, 28', and are further connected through capacitors 48, 48' to ground. The collectors of transistors 40, 40', 42, 42' are further connected to a pair of series resistors 24, 24', 26, 26'. The resistors 26, 26' are attached to the base of transistors 36, 36' and the resistors 24, 24' are attached to the base of the transistors 34, 34'. Transistors 34, 34', 36, 36' are PNP transistors.

The emitters of the transistors 36 , 36' are connected to the emitters of the transistors 34, 34'. The collectors of the transistors 36, 36' are connected in parallel with the collectors of the transistors 34, 34', and connected in series to the cathodes of diodes 46, 46'. The anodes of diodes 46, 46' are connected serially to resistors 22, 22'. The resistors are further connected to ground. The collectors of transistors 34, 34' are serially connected to inductors 50, 50', and the inductors 50, 50' are connected in parallel to the resistors 22, 22'. A magnetic disc 14 contained within a flip-dot display is disposed centrally between the inductors 50, 50' of the identical magnetic pulse generating circuits 18, 18'.

The microprocessor 16 is electrically connected to magnetic pulse generating circuits 18, 18', for driving the magnetic disc 14 of the flip-dot display, as shown in FIG. 3. This configuration is embodied in the housing 10 of the electronic parking meter, such that a viewing area 12 displays an associated operating message, such as an associated time interval.

The associated operating message is determined by the microprocessor and related circuits, such as a coin discriminator circuit. Once activated, the microprocessor selectively activates the magnetic pulse generating circuits 18, 18' to display the associated operating message via the magnetic disc 14 of the flip-dot display.

The magnetic disk 14 has both first and second positions. Activating the magnetic disk 14 into the first position via the magnetic pulse generating circuit 18 establishes a set position for the operating message. Activating the second position via the magnetic pulse generating circuit 18' establishes a reset position for the operating message.

The operating message is displayed in the viewing area 12 of the housing 10. The operating message is highly visible to law enforcement officials and viewers passing by a parking space associated with the highly visible parking meter.

Although other modifications and changes may be suggested by those skilled in the art, it is the intention of the inventor to embody within the patent warranted hereon all changes and modifications as reasonably and properly come within the scope of his contribution to the art.

I claim as my invention:

1. An electronic parking meter comprising:

a microprocessor for determining an associated operating message in response to actuation by a parking meter insert;

magnetic pulse generating circuit means electrically connected to the microprocessor, including an inductor for generating a magnetic pulse; and a flip-dot display having a permanently magnetized disk, the permanently magnetized disk having first and second positions determined by the magnetic pulse of the magnetic pulse generating circuit means, the associated operating message being displayed by selectively activating the first and second positions of the flip-dot display, the positions being visible through a viewing area in a housing for an electronic parking meter.

2. In an electronic parking meter of the type having a microprocessor electrically connected to a visual display for showing an associated operating message in response to the insertion of a parking meter insert into the electronic parking meter, the improvement comprising:

a magnetic pulse generating circuit, having an inductor for generating a magnetic pulse; and a flip-dot display having a magnetic disk selectively arranged in first and second positions, the first position being a set position, and the second position being a reset position, the first and second positions being determined by the transmission of a magnetic pulse to the magnetic disk of the flip-dot display via the magnetic pulse generating circuit, the flip-dot display being housed in a viewing area of an electronic parking meter, the flip-dot display being highly visible via the viewing area of the electronic parking meter to a viewer or law enforcement official passing the viewing area of the electronic parking meter.

3. An electronic parking meter comprising:

housing means forming a viewing area through which an operating message is displayed;

flip-dot display means for displaying a visibly enhanced, light-reflecting operating message, including a magnetic disk having first and second positions, the flip-dot display means being arranged within the housing means; and magnetic pulse generating circuit means having means for activating the first and second positions of the magnetic disk, the magnetic pulse generating circuit means being arranged within the housing means for selectively activating the flip-dot display means by a selectively generated magnetic field, said selectively generated magnetic field being drive by a microprocessor housed within the housing means.

* * * * *